US012747926B2

(12) United States Patent
Batten

(10) Patent No.: US 12,747,926 B2
(45) Date of Patent: Sep. 29, 2026

(54) RIFLE TRIPOD SUPPORT ASSEMBLY

(71) Applicant: Shawn Batten, St. John, KS (US)

(72) Inventor: Shawn Batten, St. John, KS (US)

( * ) Notice: Subject to any disclaimer, the term of this patent is extended or adjusted under 35 U.S.C. 154(b) by 0 days.

(21) Appl. No.: 18/526,169

(22) Filed: Dec. 1, 2023

(65) Prior Publication Data

US 2024/0133651 A1 Apr. 25, 2024

(51) Int. Cl.
*F41A 23/12* (2006.01)
*F41A 9/65* (2006.01)
*F41A 19/11* (2006.01)

(52) U.S. Cl.
CPC ..... *F41A 23/12* (2013.01); *F41A 9/65* (2013.01); *F41A 19/11* (2013.01)

(58) Field of Classification Search
CPC ..... F41A 19/11; F41A 9/61; F41A 9/65
See application file for complete search history.

(56) References Cited

U.S. PATENT DOCUMENTS 1,589,764 A * 6/1926 Rempt ..... F41A 3/22 42/18
1,898,670 A * 2/1933 Laudensack ..... F41A 9/55 42/49.02
2,926,448 A * 3/1960 Stam ..... F41C 23/16 42/71.01
2,997,803 A * 8/1961 Florence ..... F41A 9/70 42/50
3,062,114 A * 11/1962 Palos ..... F41J 5/10 42/106
3,739,515 A * 6/1973 Koon, Jr. ..... F41C 23/00 42/71.01
4,237,638 A * 12/1980 Trexler ..... F41A 11/02 42/6

(Continued)

FOREIGN PATENT DOCUMENTS

DE 202018000117 U1 * 5/2018
EP 2180283 A2 * 4/2010 ..... F41A 17/38

(Continued)

OTHER PUBLICATIONS

Kraford and Lypt Impact Gravity Rail. "Kraford". <https://web.archive.org/web/20220520011058/https://krafordandlypt.com/products/short-impact-arca-rail>. May 20, 2022 (Year: 2022).*

(Continued)

*Primary Examiner* — Gabriel J. Klein
(74) *Attorney, Agent, or Firm* — Kenneth H. Jack; Davis & Jack, L.L.C.

(57) ABSTRACT

A rifle support assembly incorporating a trigger guard mounting flange having breechward and muzzleward ends; a first tail having a breechward end and a muzzleward end, the first tail's breechward end being positioned muzzlewardly from the flange's breechward end and the first tail's muzzleward end being positioned breechwardly from the flange's muzzleward end, the first tail being fixedly attached to and extending leftwardly from the flange; and a second tail having breechward and muzzleward ends, the second tail's breechward end being positioned muzzlewardly from the flange's breechward end and the second tail's muzzleward end being positioned breechwardly from the flange's muzzleward end, the second tail being fixedly attached to and extending rightwardly from the flange.

9 Claims, 10 Drawing Sheets

(56) References Cited

U.S. PATENT DOCUMENTS

| | | | | |
|---|---|---|---|---|
| 9,488,437 | B1 * | 11/2016 | Schnog | F41J 5/10 |
| 12,140,390 | B1 * | 11/2024 | Newsome | F41A 19/12 |
| 2005/0115142 | A1 * | 6/2005 | Kim | F41C 27/00 42/146 |
| 2011/0162249 | A1 * | 7/2011 | Woodmansee, III | F41G 1/00 42/114 |
| 2012/0085009 | A1 * | 4/2012 | Crow | F41A 3/66 42/6 |
| 2015/0211820 | A1 * | 7/2015 | McRee | F41A 11/02 42/16 |
| 2015/0285577 | A1 * | 10/2015 | Faifer | F41C 23/16 42/94 |
| 2017/0030667 | A1 * | 2/2017 | Eitan | F41A 11/02 |
| 2017/0138683 | A1 * | 5/2017 | Addis | F41A 9/64 |
| 2022/0282950 | A1 * | 9/2022 | Aldstadt | F41C 23/16 |

FOREIGN PATENT DOCUMENTS

| | | | |
|---|---|---|---|
| KR | 102254232 | B1 * | 5/2021 |
| KR | 102321620 | B1 * | 11/2021 |

OTHER PUBLICATIONS

DDIY Arca Rail. "ARCA". <https://imgur.com/gallery/diy-arca-rail-Klo105h>. Jan. 15, 2021. (Year: 2021).*

Kraford and Lypt Gen3 Arca-Swiss Trigger Guard. <https://web.archive.org/web/20220814003115/https://www.airgundepot.com/kraford-and-lypt-gen3-arca-trigger-guard-black.html>. Aug. 14, 2022. (Year: 2022).*

M1911 RIS Mount; gunfire.com.

ACC Premier Chassis System https://mdttac.com/acc-chassis-system/.

Really Right Stuff BAX15 Auxiliary Plate for Accuracy International AIAX/AXMC chassis https://www.midwayusa.com/product/1024283524?pid=122571.

LRI Trigger Guard https://www.longriflesinc.com/collections/products/products/trigger-guard?variant=19517293068381.

SaberTacticalFXImpact Arca Swiss Rail https://www.topgun-airguns.com/product/fx-impact-arca-swiss-rail/.

Arca Rail Tripod Mount Adapter https://www.amazon.com/Adapter-Ballhead-Compatiable-Dovetail-interface/dp/B0946V8DCQ?th=1.

Saber FX Impact Extended ARCA Rail https://www.bracesofbristol.com/product/saber-tactical-fx-impact-extended-arca-rail/.

High Desert Rifle Works Tikka https://highdesertrifleworks.com/products/black-high-desert-rifle-works-tikka-t3-aluminum-trigger-guard-back-ordered.

FX Impact Easy Access Short Trigger Guard https://krafordandlypt.com/products/fx-impact-easy-access-short-trigger-guard.

Trigger Guard Assembly for Ruger https://www.brownells.com/gun-parts/rifle-parts/rifle-triggers-parts/trigger-guard-assembly-ss/.

Trigger Guard—Universal https://ahlmans.com/cart/trigger-guard-universal-1550561381.html?search=trigger%20guard&category_id=0.

NcStar APLS Aluminum Red Laser Sight Metal Pistol Trigger Guard Mount https://kdsportinggroup.com/ncstar-apls-aluminum-red-laser-sight-metal-pistol-trigger-guard-mount-black/.

Ncstar Trigger Guard Mount With Weaver Rail https://extremeairsoftri.com/products/ncstar-trigger-guard-mount-with-weaver-rail?_pos=1&_psq=NCstar+trigger&_ss=e&_v=1.0.

* cited by examiner

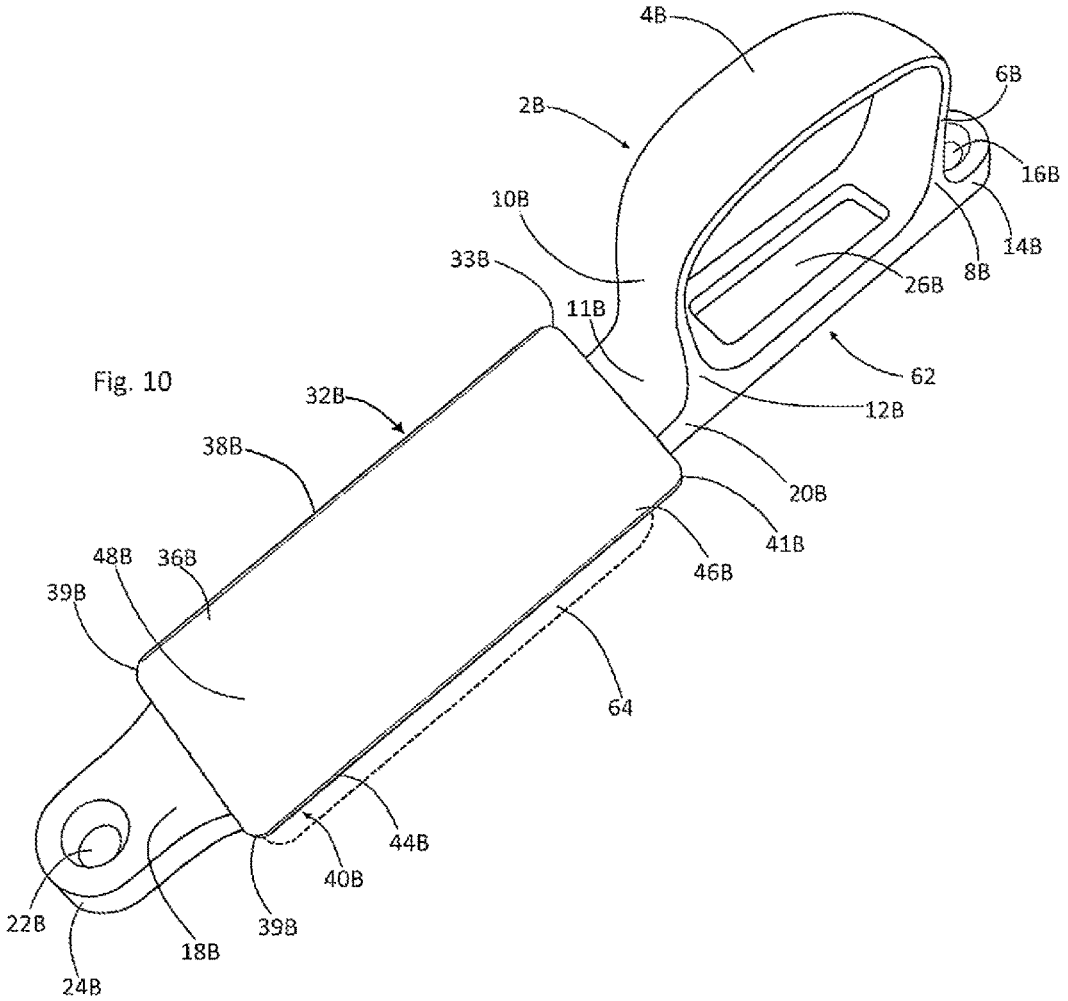
Fig. 10
Fig. 11
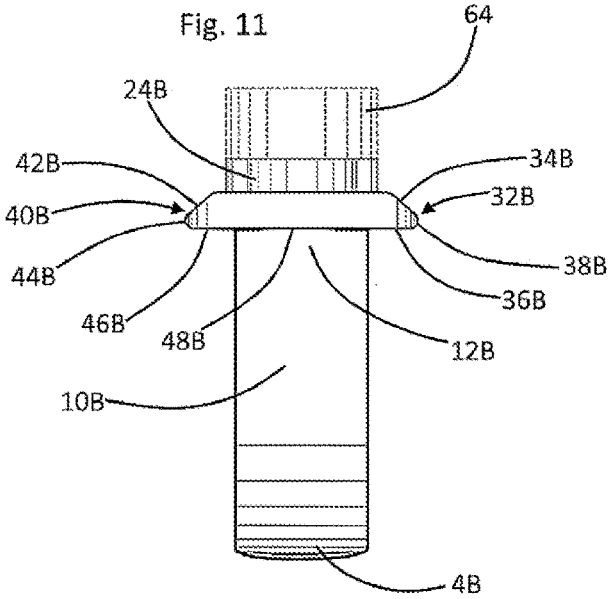
Fig. 12
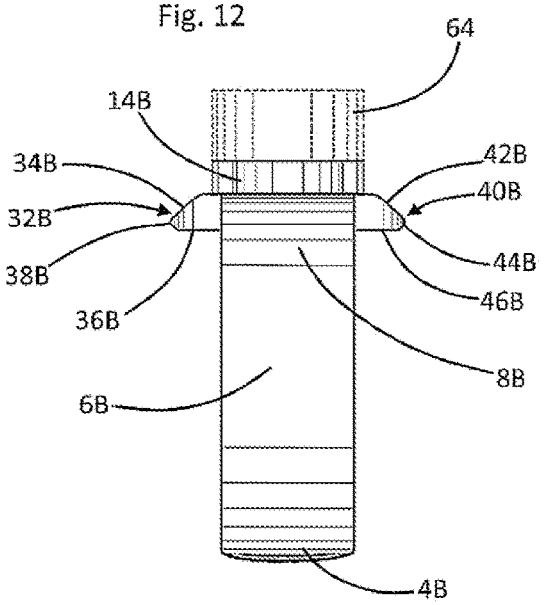

RIFLE TRIPOD SUPPORT ASSEMBLY

FIELD OF THE INVENTION

This invention relates to apparatus and assemblies for tripod or bipod support of rifles during precision rifle firing.

BACKGROUND OF THE INVENTION

During marksmanship or precision rifle firing, the forestock or muzzleward end of a rifle is often supported by a tripod or a bipod. Known mounting assemblies for attachment and interconnection of an upper firearm connecting adaptor of a bipod or tripod to a rifle are often mechanically complex, often resulting in an insecure attachment of the bipod or tripod to the rifle. Such rifle support assemblies are also known to attach to a rifle at a disadvantageous point with respect to the rifle's longitudinal and vertical centers of gravity.

The instant inventive rifle tripod support assembly solves or ameliorates the above discussed problems, defects, and challenges of known bipod and tripod firearm mounting assemblies by providing specialized adaptations of the forward mounting flange component of a commonly configured rifle trigger guard.

OBJECTS AND SUMMARY OF THE INVENTION

A first structural component of the instant inventive rifle tripod support assembly comprises a front or muzzleward trigger guard mounting flange, such flange having a breechward end and a muzzleward end. The trigger guard mounting flange component of the invention preferably extends forwardly or muzzlewardly from an upper end of a forward wall of a loop portion of a commonly configured trigger guard.

A further structural component of the instant inventive assembly comprises a first clamp jaw engaging tail component, such component having a breachward end and a muzzleward end. In a preferred embodiment, a breachward end of the assembly's first tail component is positioned slightly muzzlewardly from the trigger guard mounting flange's breachward end, the first tail component's muzzleward end being suitably positioned breachwardly from such flange's muzzleward end. In a suitable alternate configuration, the muzzleward end of the first tail component may be longitudinally elongated via extension muzzlewardly beyond the muzzleward end of the trigger guard mounting flange. Where the trigger guard mounting flange itself is longitudinally elongated for cartridge magazine base support, the first tail component may be commensurately longitudinally elongated. The first tail component of the instant inventive assembly necessarily extends leftwardly from a leftward side of the trigger guard mounting flange.

A further structural component of the instant inventive assembly comprises a first clamp jaw engaging tail component, such component having a breechward end and a muzzleward end. In a preferred embodiment, a breechward end of the assembly's first tail component is positioned slightly muzzlewardly from the trigger guard mounting flange's breechward end, the first tail component's muzzleward end being suitably positioned breechwardly from such flange's muzzleward end. In a suitable alternate configuration, the muzzleward end of the first tail component may be longitudinally elongated via extension muzzlewardly beyond the muzzleward end of the trigger guard mounting flange. Where the trigger guard mounting flange itself is longitudinally elongated for cartridge magazine base support, the first tail component may be commensurately longitudinally elongated. The first tail component of the instant inventive assembly necessarily extends leftwardly from a leftward side of the trigger guard mounting flange.

The junctures between the assembly's first and second tail components and the trigger guard mounting flange preferably comprise integral or whole formations, and the combined lateral cross-sectional profile of the first and second tail components preferably approximates the lateral cross-sectional shape of a dovetail configured ARCA or Swiss rail.

In use of the instant inventive rifle support assembly, and assuming that the assembly's trigger guard mounting flange component is solidly mounted by a screw fastener at the undersurface of a rifle's stock, left and right jaws of an upper clamp adapter of a rifle support tripod may respectively engage the assembly's first and second tails. References herein to rifle supporting tripods are intended to broadly refer to and include rifle supporting bipods.

Such clamp jaw engagements advantageously provide support to the rifle at an elevation above the lower floor of the loop of the rifle's trigger guard, advantageously supporting the rifle near the rifle's vertical center of gravity. Such clamp jaw engagements also provide balanced rifle support at a point located muzzlewardly from the trigger guard's trigger encircling loop, advantageously positioning the tripod at or near the rifle's longitudinal center of gravity.

Accordingly, objects of the instant invention include the provision of a rifle tripod support assembly which incorporates structures as described above, and which arranges those structures in relation to each other in manners described above for the performance of functions as described above.

Other and further objects, benefits, and advantages of the instant invention will become known to those skilled in the art upon review of the detailed description which follows, and upon review of the appended drawings.

BRIEF DESCRIPTION OF DRAWINGS

FIG. 10 is a lower perspective view of the structure of FIG. 8.

FIG. 11 is a rearward or breechward view of the structure of FIG. 8.

FIG. 12 is a forward or muzzleward view of the structure of FIG. 8.

DETAILED DESCRIPTION OF THE INVENTION

Figure 1:
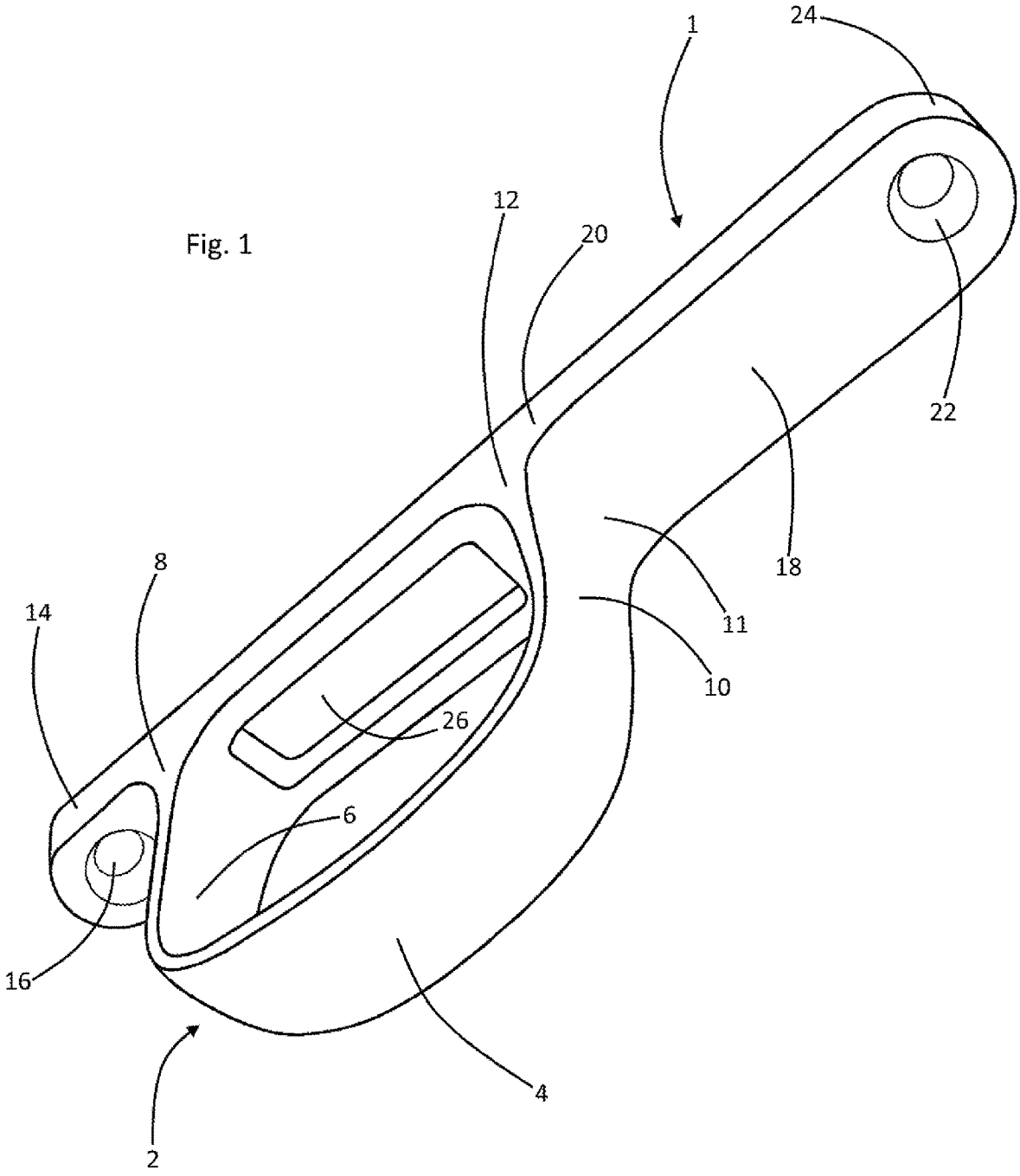
FIG. 1 is a perspective view of a prior art rifle trigger guard, such guard including a prior art muzzlewardly extending mounting flange.
Figure 2:
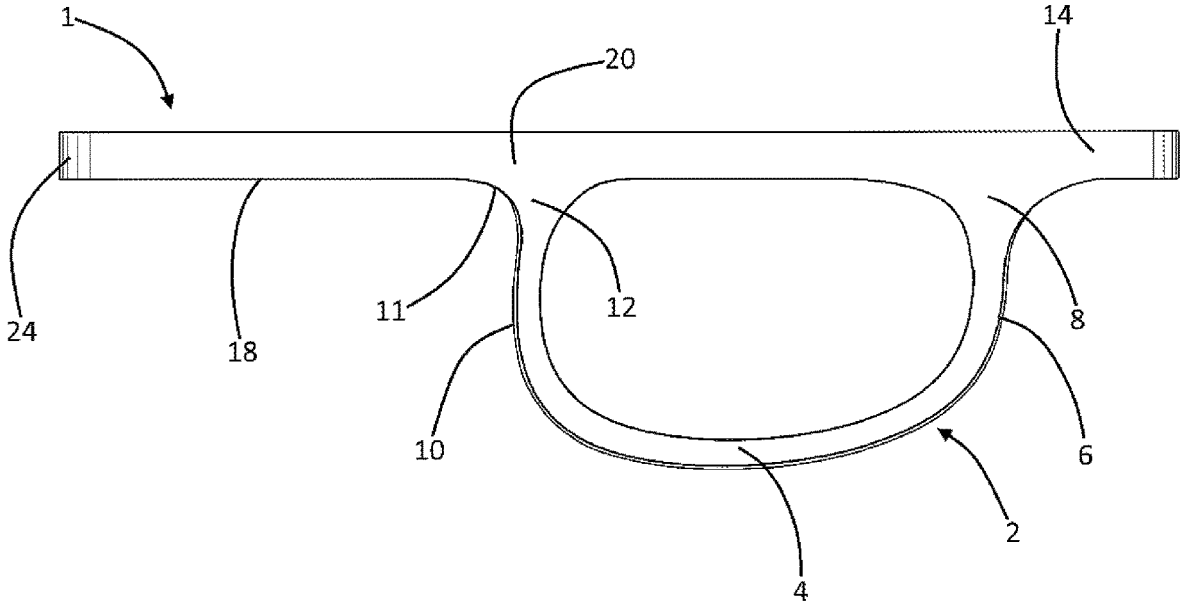
FIG. 2 is a left side view of the structure of FIG. 1.
Figure 3:
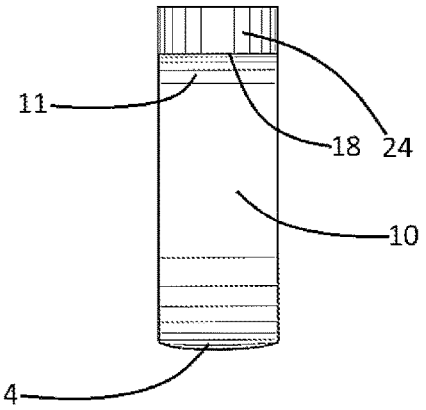
FIG. 3 is a rearward or breechward view of the structure of FIG. 1.

Referring now to the drawings and in particular to FIGS. 1-3, a prior art rifle trigger guard mounting flange is referred to generally by reference arrow 1, such flange constituting an integral or wholly formed component of a commonly configured prior art rifle trigger guard. The depicted prior art trigger guard includes a trigger encircling and protecting loop which is referred to generally by reference arrow 2, such loop comprising a lower floor 4, a rear or breechward wall 6, and a front or muzzleward wall 10. The prior art trigger guard typically further includes a rear mounting flange 14 which is fixedly attached to and extends breechwardly from an upper end 8 of the loop's rear wall 6, such flange 14 having a mounting screw receiving eye 16. A trigger passage port 26 is commonly formed between the upper ends 8 and 12 of the loop's rear and front walls 6 and 10.

The prior art trigger guard's forwardly or muzzlewardly extending mounting flange 1 has an extreme forward or muzzleward end 24, and has a rearward or breechward end 20 which is fixedly attached to or formed wholly with the upper end of the loop's front wall 10. The muzzleward end 24 of the prior art mounting flange 1 commonly presents a screw receiving eye 22, and the undersurface of such flange's breechward end 20 commonly presents a curved transition 11 from the muzzleward surface of wall 10 to the lower surface 18 of flange 1.

Figure 4:
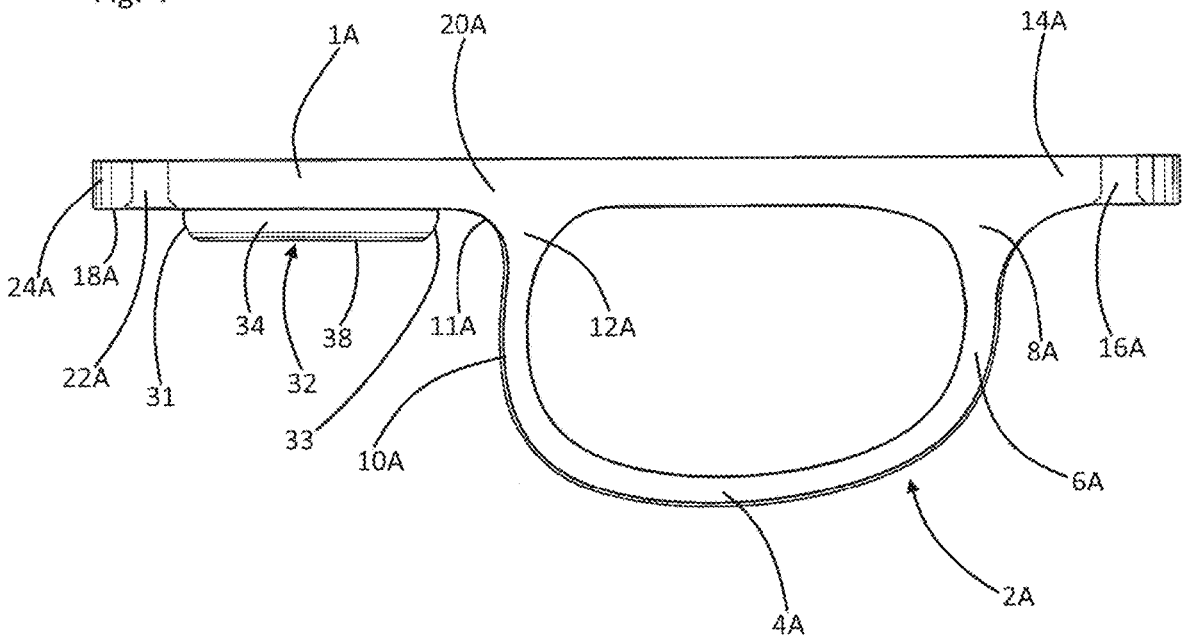
FIG. 4 is a side view of a suitable embodiment of the instant inventive rifle support assembly.
Figure 5:
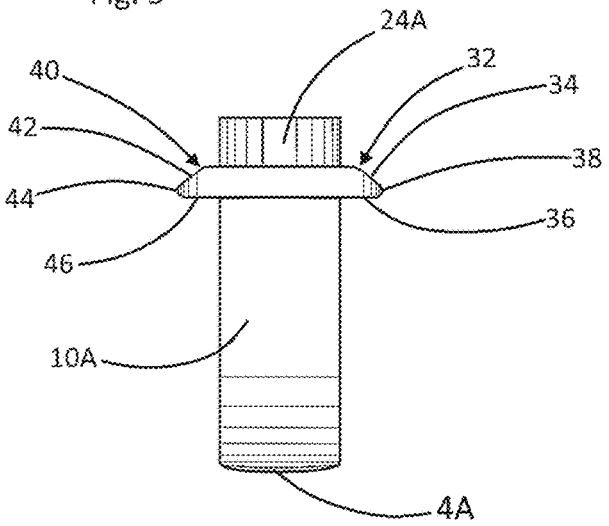
FIG. 5 is a breechward or rearward view of the structure of FIG. 4.
Figure 6:
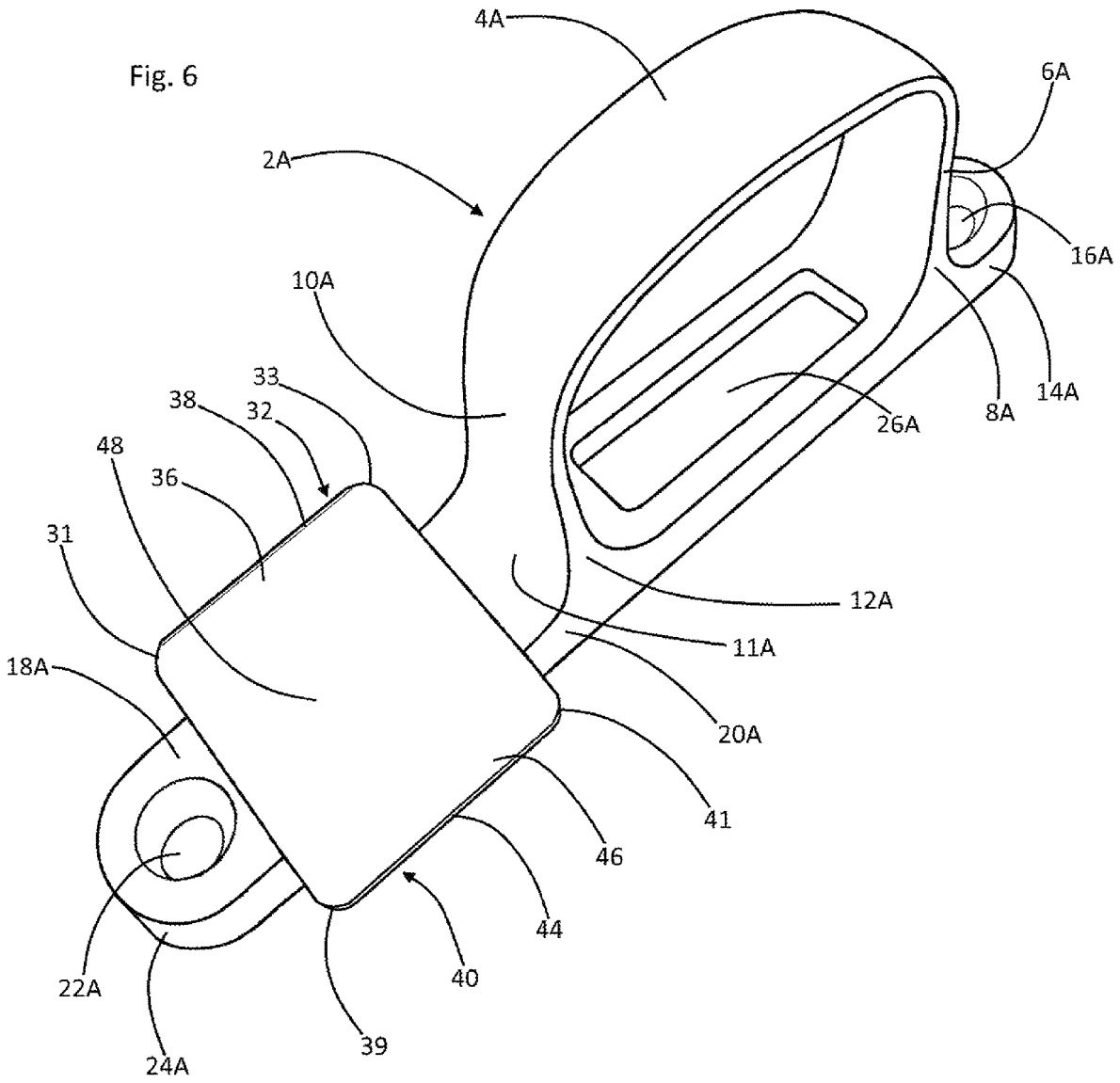
FIG. 6 is a perspective and lower view of the structure of FIG. 4.

Referring further simultaneously to FIGS. 4-6, the instant inventive rifle tripod support assembly may suitably incorporate the prior art structures of FIGS. 1-3. Accordingly, all structures appearing in FIGS. 4-6 which are identified by a reference numeral having a suffix "A" are configured similarly with similarly numbered structures depicted in FIGS. 1-3. In the suitable embodiment of the inventive assembly depicted in FIGS. 4-6, a first tail component is identified by reference arrow 32, such component being fixedly attached to or formed wholly with the undersurface 18A of mounting flange 1A. A second tail component identified by reference arrow 40 mirroringly extends rightwardly from flange 1A. The assembly's leftwardly and rightwardly extending tail components 32 and 40 are preferably adapted for left and right tripod clamp jaw engagements.

The clamp jaw engaging left tail 32 has a muzzleward end 31 and a breechward end 32, and the right tail 40 mirroringly presents muzzleward and breechward ends 39 and 41. The tails' left and right the muzzleward ends 31 and 39 are suitably positioned slightly breechwardly from screw eye 22A, while the tails' breechward ends 33 and 41 are suitably positioned muzzlewardly from the trigger guard's curved transition 11A. To achieve secure tripod clamp jaw contacts and engagements, the longitudinal lengths or breechward to muzzleward lengths of the tail components 32 and 40 are preferably at least one inch.

Rifle trigger guard front flange components, and fitted gun stock recesses which receive such flanges, commonly have a longitudinal dimension of at least 1½ inches, such dimension accommodating the preferred at least 1 inch longitudinal dimension of the clamp jaw engaging tails 32 and 40.

To further accommodate secure engagements of the assembly's left and right tail components 32 and 40 with commonly configured rifle tripod clamps, such tails preferably present angled clamp jaw engaging faces 34,36,42, and 46. In the FIGS. 4-6 embodiment, lower tail faces 36 and 46 extend substantially horizontally, and face downwardly, while upper tail faces 34 and 42 extend at angle approximately 45° above horizontal. In combination with each other, the 45° angular orientations of the upper tail faces 34 and 42 advantageously form a dovetail configuration of the type commonly presented in an ARCA or a Swiss adaptor. Accordingly, each tail among the left and right tails 32 and 40 constitutes a dovetail in character and geometric configuration.

To further conform the inventive assembly's clamp jaw engaging tails 32 and 40 with an ARCA or Swiss adapter configuration, the lateral displacements of left and right "V" angle vertices 38 and 44 which are formed by the tails' angled faces 34 and 36 and 42 and 46 are approximately 1½ inches away from each other. To eliminate sharp edges at the vicinity of the trigger guard, such vertices 38 and 44 are curved or rounded.

In use of the instant inventive assembly, the left and right jaws of an ARCA adapter engaging tripod clamp (not depicted within views) may respectively engage the assembly's leftwardly and rightwardly extending tail components 32 and 40. The jaws of such clamp advantageously include contact faces angled at 45° to form left and right "V" shaped valleys which may securely nestingly receive and clamp against the tails 32 and 40. Such tripod clamping receipts of the assembly's tails may advantageously securely hold and support the rifle at a location above the lower floor 4A of the trigger guard loop 2A, and is further located muzzlewardly from such loop.

Figure 7:
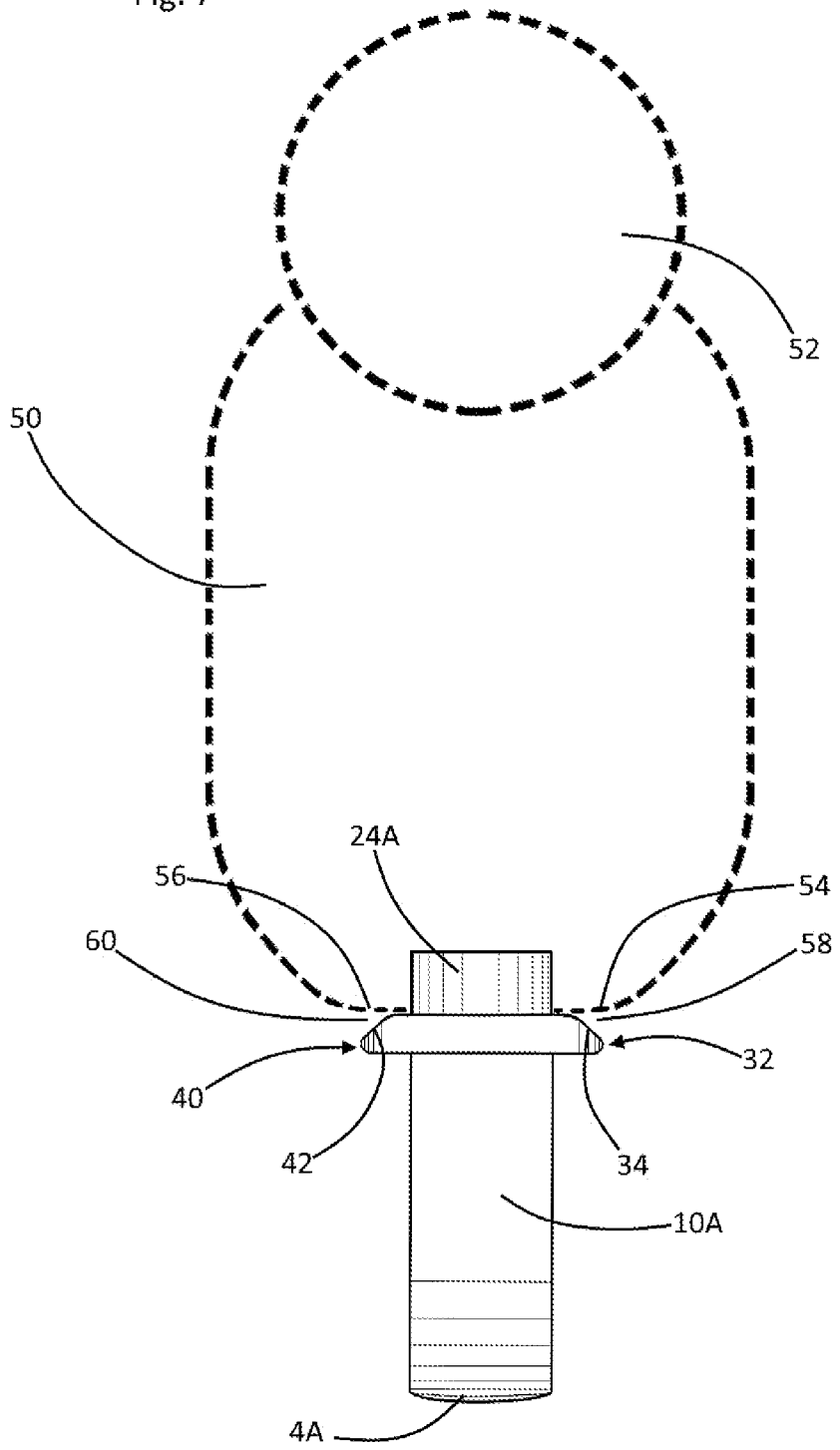
FIG. 7 re-depicts the structure of FIG. 5, the view of FIG. 7 showing the instant inventive assembly mounted beneath a rifle stock.
Figure 8:
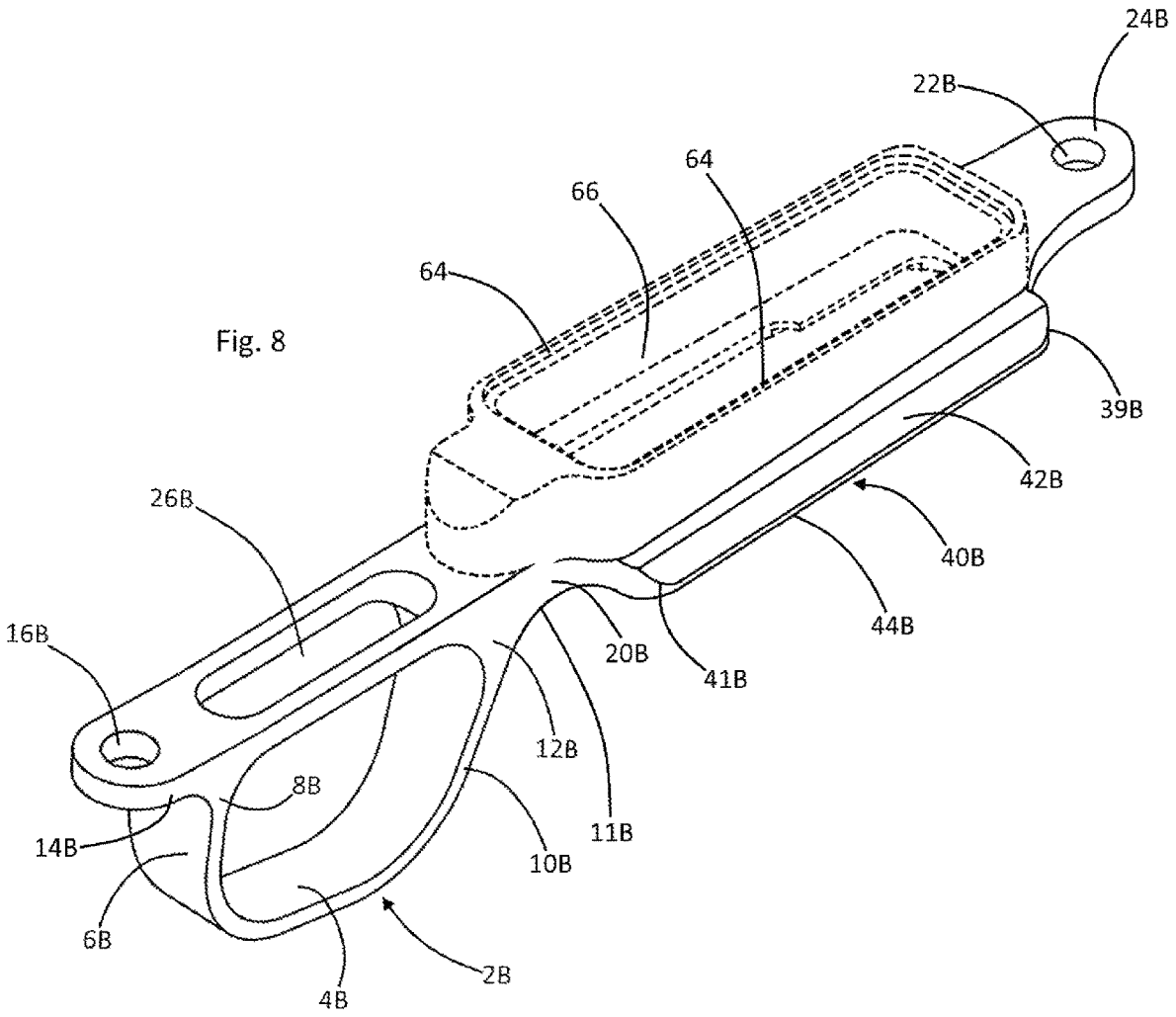
FIG. 8 is a perspective view of a suitable alternative configuration of the instant inventive assembly.
Figure 9:
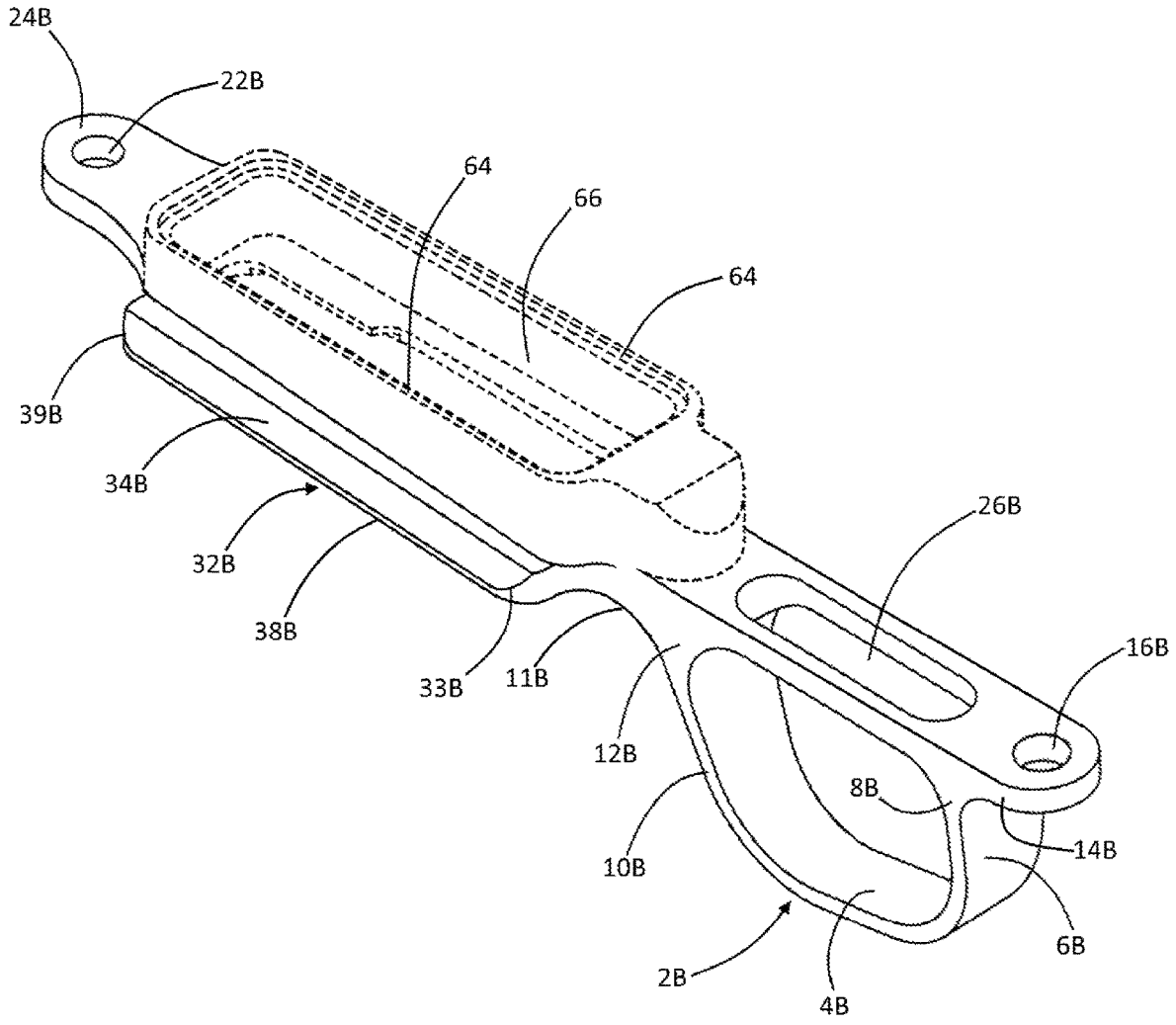
FIG. 9 is a reverse perspective view of the structure of FIG. 8.

Referring further to FIG. 7, the mounting flange 1A is shown upwardly nestingly received within downwardly opening recess within the stock 50 of a rifle, such rifle stock supporting a breach mechanism 52. The preferred 45° angles formed by the upper tail faces 34 and 42 advantageously additionally form leftwardly opening and rightwardly opening "V" shaped valleys 58 and 60 beneath the left and right under surfaces 54 and 56 of the rifle stock 50. Such openings 58 and 60 advantageously provide clearance spaces above the tails 32 and 40 into which the left and right jaws of a tripod clamp may extend.

Referring to FIG. 6, lower tail faces 36 and 46 may be horizontally continuous with each other, such continuity of surfaces forming a substantially flat lower dovetail surface 48.

Referring simultaneously to FIGS. 1-12, all structures depicted in FIGS. 8-12 and identified by a reference numeral having a suffix "B" are configured similarly with similarly numbered structures appearing in FIGS. 1-7. In the FIGS. 8-12 configuration of the instant inventive assembly, the left and right clamp jaw engaging tail components 32B and 40B are longitudinally elongated in excess of the minimum 1 inch lengths of the tails 32 and 40 of the FIGS. 4-7 configuration. Such tail elongations advantageously allow the tails' upper surfaces along with the trigger guard's front mounting flange to support upwardly extending walls 64 shown in dashed lines, such walls 64 forming and defining within the rifle a cartridge magazine space 66. The longitudinal elongation of the left and right tails 32B and 40B is suitably commensurate with the longitudinal dimension of the rifle's cartridge magazine, such magazine's lower end being bounded and defined by walls 64. In addition to facilitating magazine base support, the tail component elongations of the FIGS. 8-12 configuration facilitate selective and variable front to rear mounting of the ARCA tripod clamp. Accordingly, such tail elongations advantageously facilitate selective longitudinal balancing of the rifle while clamped upon and supported by the tripod.

Figure 13:
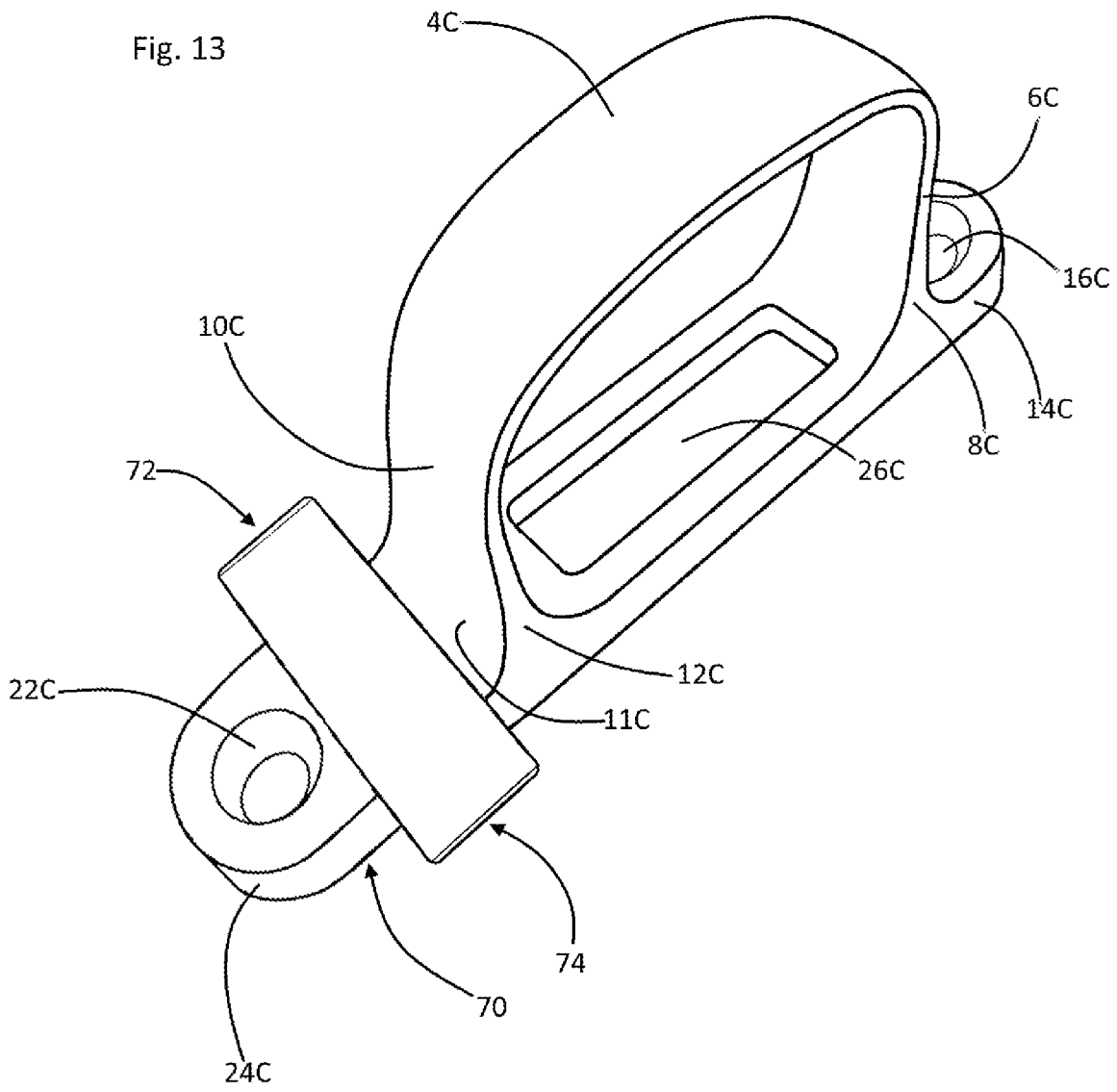
FIG. 13 presents another alternative configuration of the instant inventive assembly.

Referring to FIG. 13, all structures identified by a reference numeral having the suffix "C" are configured similarly with similarly numbered structures appearing in FIGS. 1-12. In the FIG. 13 configuration, the longitudinal distance or displacement along mounting flange 70 between the curved trigger guard loop transition 11C and the front screw eye 22C may be substantially shortened for fitted and nesting receipt of the trigger guard within a particular gun stock's trigger guard mounting recess (not depicted within views). To accommodate such trigger guard fitting and dimensional shortening, the longitudinal lengths of the inventive assembly's left and right tail components 72 and 74 may be commensurately shortened to include longitudinal dimensions which are less than the preferred 1 inch minimum tail length. Such longitudinally shortened tails 72 and 74 remain capable of facilitating clamped engagements with the typically longitudinally longer left and right jaws of an ARCA tripod clamp.

Figure 14:
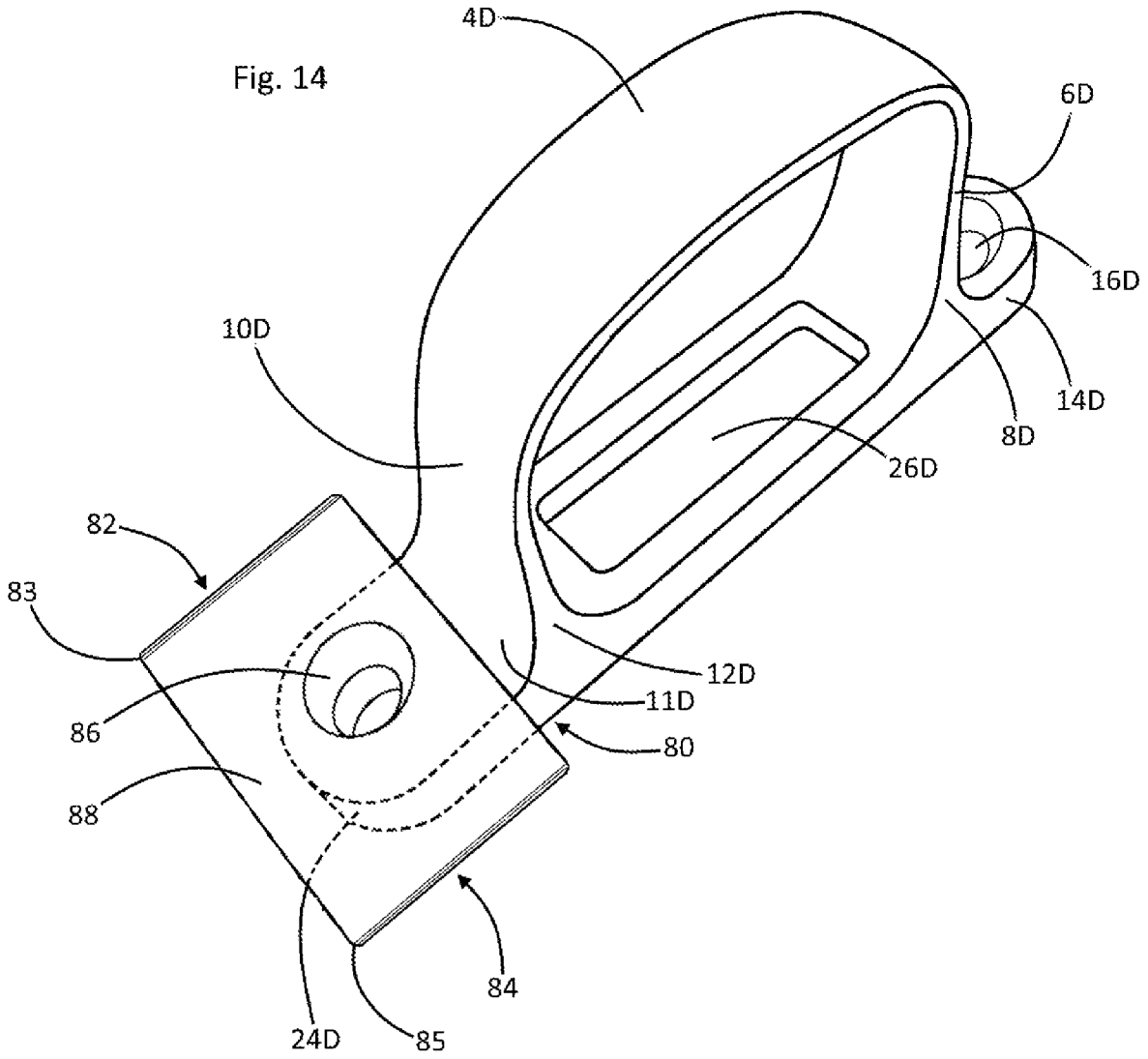
FIG. 14 presents another alternative configuration of the instant inventive assembly.

Referring further simultaneously to FIG. 14, all structures identified by a reference numeral having a suffix "D" are configured substantially identically with similarly numbered structures appearing in FIGS. 1-13. In the FIG. 14 configuration, the longitudinal lengths of alternatively configured clamp jaw engaging tails 82 and 84 may suitably exceed the longitudinal displacement of eye 86 from curved transition 11D. In order to facilitate enhanced ARCA clamping jaw contacts, the muzzleward ends 83 and 85 of such elongated tails 82 and 84 may extend muzzlewardly beyond the extreme muzzleward end 24D of mounting flange 80.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention claimed is:

1. An assembly for mounting a tripod to a rifle, wherein the tripod comprises a clamp, wherein the clamp comprises left and right "V" shaped valleys, wherein the rifle comprises a muzzle, a breech, and a cartridge magazine, and wherein the cartridge magazine has breechward and muzzleward ends and has a lower end bounded and defined by left and right walls, said assembly comprising:

a. a first "V" shaped tail fitted for receipt within the clamp's left "V" shaped valley, wherein the first "V" shaped tail is fixedly attached to and extends leftwardly from the cartridge magazine's left wall;

b. a second "V" shaped tail fitted for receipt within the clamp's right "V" shaped valley, wherein the second "V" shaped tail is fixedly attached to and extends rightwardly from the cartridge magazine's right wall;

c. a screw eye positioned muzzlewardly from the muzzleward end of the cartridge magazine, wherein muzzleward ends of the first and second "V" shaped tails are positioned breechwardly from the screw eye.

2. The assembly for mounting a tripod to a rifle of claim 1 wherein muzzleward ends of the first and second "V" shaped tails are positioned muzzlewardly from the cartridge magazine's breechward end.

3. The assembly for mounting a tripod to a rifle of claim 2 wherein each "V" shaped tail among the first and second "V" shaped tails comprises a dove tail.

4. The assembly for mounting a tripod to a rifle of claim 3 wherein each dove tail comprises a lower surface and an upper surface, wherein said lower surfaces extend substantially horizontally, and wherein said upper surfaces extend upwardly at approximately 45° angles from horizontal.

5. The assembly for mounting a tripod to a rifle of claim 4 wherein the dove tails' upper and lower surfaces form left and right vertices, the left vertex being positioned approximately 1½ inch leftwardly from the right vertex.

6. The assembly for mounting a tripod to a rifle of claim 5 further comprising left and right curved transitions, said transitions being respectively positioned at the left and right vertices.

7. A rifle tripod support assembly for a rifle having a muzzle and a breech, the rifle tripod support assembly comprising:

a. a cartridge magazine having a left side, a right side, a breechward end, and a muzzleward end;

b. a first dove tail having a breechward end and a muzzleward end, said first dove tail being fixedly attached to and extending leftwardly from the left side of the cartridge magazine;

c. a second dove tail having a breechward end and a muzzleward end, said second dove tail being fixedly attached to and extending rightwardly from the right side of the cartridge magazine;

d. a screw eye positioned muzzlewardly from the muzzleward end of the cartridge magazine, the muzzleward ends of the first and second dove tails being positioned breechwardly from the screw eye; and e. a trigger guard loop transition positioned at breechward ends of the first and second dove tails, the breechward ends of the first and second dove tails being positioned muzzlewardly from the trigger guard loop transition; wherein each dove tail comprises a lower surface and an upper surface, wherein said lower surfaces extend substantially horizontally, and wherein said upper surfaces extend upwardly at approximately 45° angles from horizontal; wherein the dove tails' upper and lower surfaces form left and right vertices comprising curved transitions, the left vertex being positioned approximately 1½ inch leftwardly from the right vertex.

8. The rifle tripod support assembly of claim 7 wherein the screw eye is positioned muzzlewardly from the trigger guard loop transition at least 1½ inches.

9. The rifle tripod support assembly of claim 8 wherein the muzzleward ends of the first and second dove tails are positioned at least 1 inch muzzlewardly from said tails' breechward ends.

* * * * *